US008651581B2

(12) United States Patent
Weigel

(10) Patent No.: US 8,651,581 B2
(45) Date of Patent: Feb. 18, 2014

(54) SAFETY DEVICE FOR THE MOVABLE EXCAVATION DEVICES IN AN UNDERGROUND LONGWALL MINE

(75) Inventor: Wilfried Weigel, Werne (DE)

(73) Assignee: Tiefenbach Control Systems GmbH, Bochum (DE)

( * ) Notice: Subject to any disclaimer, the term of this patent is extended or adjusted under 35 U.S.C. 154(b) by 146 days.

(21) Appl. No.: 13/181,286

(22) Filed: Jul. 12, 2011

(65) Prior Publication Data

US 2012/0074759 A1 Mar. 29, 2012

(30) Foreign Application Priority Data

Jul. 30, 2010 (DE) ..... 10 2010 032 913

(51) Int. Cl.
*E21C 35/04* (2006.01)

(52) U.S. Cl.
USPC ..... 299/1.6

(58) Field of Classification Search
USPC ..... 299/1.05, 1.3, 1.6, 1.7, 11, 12, 33, 42
See application file for complete search history.

(56) References Cited

U.S. PATENT DOCUMENTS

| | | | | |
|---|---|---|---|---|
| 4,722,574 | A * | 2/1988 | Barham et al. | 299/1.05 |
| 6,512,312 | B1 | 1/2003 | Herkenrath et al. | |
| 8,115,650 | B2 * | 2/2012 | Dasilva et al. | 340/686.6 |
| 2006/0158016 | A1 * | 7/2006 | Kessel et al. | 299/1.7 |

FOREIGN PATENT DOCUMENTS

| | | |
|---|---|---|
| DE | 195 46 427 | 8/1996 |

* cited by examiner

*Primary Examiner* — Sunil Singh
(74) *Attorney, Agent, or Firm* — Alston & Bird LLP

(57) ABSTRACT

A safety device which detects personnel data of persons located in the detection zone thereof, said safety device operating continuously or in regular cycles and reporting to the central controller. The personnel data of all persons located in the longwall mine are stored in a central storage device of the central control and constantly compared to the detected personnel data. If a discrepancy arises between the saved personnel data and the detected personnel data, the central control unit executes a command which halts all functions of the excavation devices and interrupts all moving functions, said command being directed at the switching devices of the associated excavation devices.

1 Claim, 2 Drawing Sheets

SAFETY DEVICE FOR THE MOVABLE EXCAVATION DEVICES IN AN UNDERGROUND LONGWALL MINE

CROSS-REFERENCE TO RELATED APPLICATIONS

The present application claims priority from German Patent Application No. 10 2010 032 913.4, filed Jul. 30, 2010, which is hereby incorporated herein in its entirety by reference.

BACKGROUND OF THE INVENTION

1. Field of the Invention

The invention relates to a safety device arranged on the movable excavation devices of an underground mine.

2. Description of Related Art

Such a personnel protection system is employed in underground mining operations in the areas proximate to all moving machines and machine components, for example planes, shearers, loading machines, conveyors, conveyor vehicles, and similar machines. The safety area associated with these personnel protection systems should correspond as precisely as possible to the area affected by the machines, in order to avoid superfluous work halts.

This is especially important for shield mining in a longwall mine, because the number of support shields along a longwall can range from 100 to 300 units; for this reason, on the one hand, comprehensive personnel protection is difficult, and on the other hand, losses resulting from unnecessary stoppages and the associated disruptions of operations are high. Shields are included in the definition of the term "support shields" in this description, or more generally as excavation devices. This description of the invention relates primarily to applications in longwall coal mining and to the support shields/chocks utilized therein.

As in the case of many other excavation devices those support shields in a longwall mine are moved automatically or by remote control, depending on the position and direction of movement of the mining machine. Particularly in the case of automatic processes, visual and acoustic warning signals are given. Nevertheless, a risk still exists, particularly for persons who are unexpectedly incapable of moving, or for any other reason cannot reach the emergency shutoff switch.

For the protection of all personnel in a longwall mine, it is possible to monitor their current location. With the provision of current locations for personnel, the excavation devices which pose a danger for those persons can be blocked manually or automatically by electronic control. For the purpose of detecting the current location of each person present in the longwall mine, each person is equipped with an element which is detected by a "reading device" associated to each excavation device. The presence of the element and person is then signaled to excavation device controller (device controller unit, particularly support shield controller unit) or the central control (longwall controller unit).

There are two possibilities for the technical implementation of this approach:

i. Each person in the longwall mine carries a passive element, for example a coil or a passive transponder. In each excavation device/support shield, an active transmitter/receiver element is installed, which detects this passive element.

or i. Each person in the longwall mine is equipped with an active transmitter/receiver element which is normally in standby mode (sleep mode). An element attached to each excavation device, e.g. support shield, initially activates the transmitter/receiver worn by the person, at which point said transmitter/receiver is detected and identified by means of its signals.

Such safety devices are known for support shields (chocks) from DE10029918A1 and the prior art referenced therein. In that case, the device is intended to ensure that no person is located in the area of motion in which the machine travels when the support shield is in motion. For this purpose, the area of motion is scanned by sensors which are simultaneously activated by the control unit for the support shield upon every movement of the same.

Even with this method, safety cannot be ensured in a comprehensive manner. These sensors (DE10029918A1) arranged on the support shields execute self tests at regular or irregular intervals. However it cannot be ruled out that the passive element (coil or passive transponder), or the active transmitter/receiver element which must be worn by each person, is defective or is failing for another reason to function correctly, or the safety areas of the excavation devices do not fully extend to cover all possible personnel locations. This can occur particularly in the case of coal seams with larger thicknesses.

The problem addressed by the invention is that of removing these gaps in the area of protection.

SUMMARY OF VARIOUS EMBODIMENTS

In order to solve this problem, the elements worn by personnel are provided with an identification number or another code word which enables the identification of the person carrying the element. Such data, which are only used to identify a person and not to provide a description of the person, are referred to as "personnel data" in the following description. All persons who enter a danger zone having dangerous excavation devices, particularly support shields, are detected and identified. Each of these persons can be constantly monitored on the basis of whether he or she is located in this danger zone of one of the safety zones of one of the support shields. However, if a person disappears from this monitoring system because the sensor he or she are wearing is defective, or because said person is located in the area of a support shield which has a defective sensor, or because said person is located in an area which is not covered by a safety zone of one of the support shields, all excavation devices, particularly the support shields of the danger zone are shut down such that it is no longer possible to operate the machines automatically or by remote control.

BRIEF DESCRIPTION OF THE SEVERAL VIEWS OF THE DRAWINGS

The following describes one embodiment of the invention with reference to the illustration.

Shown are.

DETAILED DESCRIPTION

Figure 1:
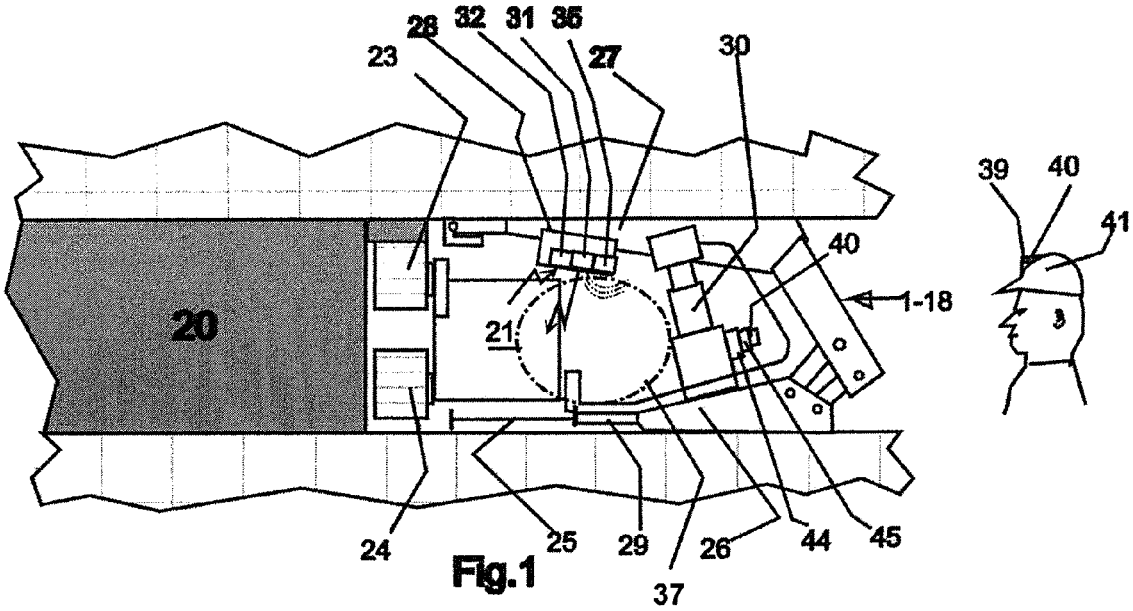
FIG. 1: The cross-section of a longwall mine, having a support shield.
Figure 2:
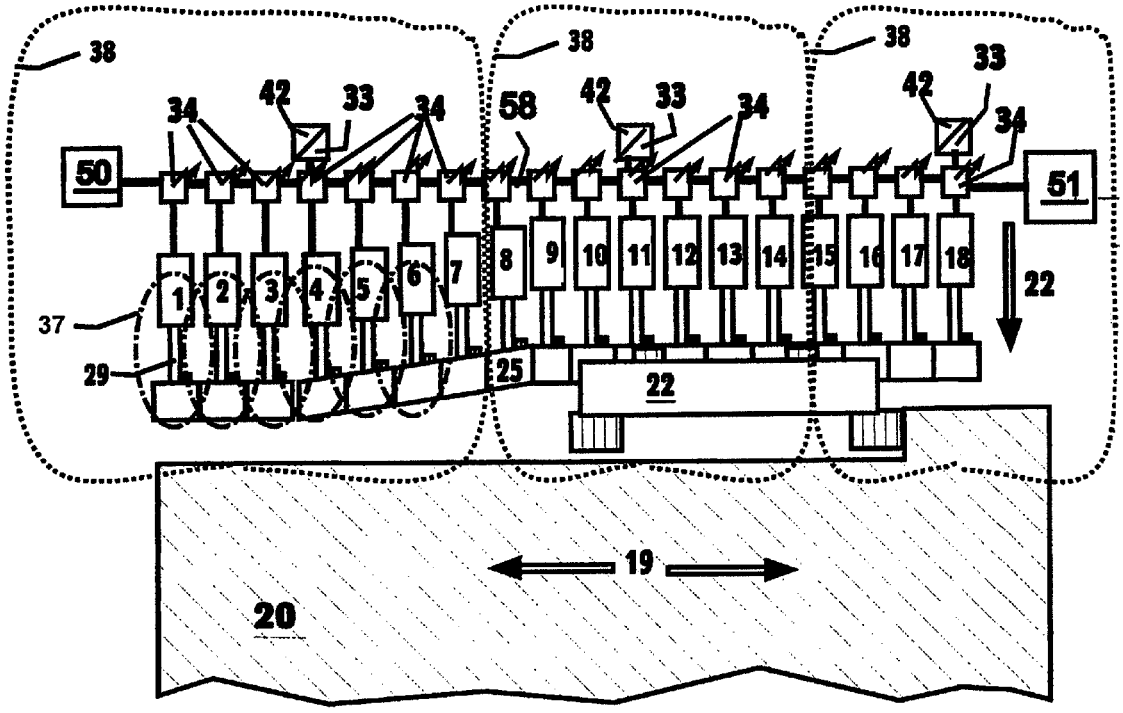
FIG. 2: The schematic view showing a shearer machine and a group of support shields.

FIG. 1 shows, as an excavation device, one of the support shields (also termed "support units") 1-18. The support shields are commonly referred to as support shields or chocks. FIG. 2 shows multiple support shields 1 to 18. The support shields are arranged along the longitudinal face of a coal seam 20. The coal seam 20 is mined in the mining direction 22 using a cutting device 23, 24 of a mining machine 21, e.g. a shearer 21.

The shearer 21 can be moved along the coal panel in the cutting direction 19 by means of a cable which is not illustrated. The broken coal is loaded onto a conveyor by the shearer. The conveyor consists of a trough 25 in which a tank track conveyor moves along the coal panel. The trough 25 is divided into individual units which are connected to each other but which can execute a movement in the mining direction 22 relative to each other. Each of the units is connected to one of the support units 1 to 18 by means of a cylinder/piston unit (stepped piston) 29, wherein said cylinder/piston unit is the power source for local movement. Each of the support shields serves the purpose of supporting the longwall mining space upward. For this purpose, additional cylinder/piston units, e.g. 30, provide tension on a roof plate which opposes a floor plate. The roof plate has a so-called coal bumper on its front end, said front end facing the coal seam. The coal bumper is a flap which can move on a hinge toward the coal seam as the coal seam is mined away. The coal bumper must be moved upward toward the seam in front of the shearer 21, said shearer moving towards the location of the coal bumper. For this purpose, an additional cylinder/piston unit is provided, which is not illustrated. These functional elements of the individual support shields are only illustrated here as an example. Additional functional elements are present; these are additional power sources, particularly hydraulic cylinder/piston units, as well as sensors for controlling automatic operation functions. These sensors are not illustrated here. These cylinder/piston units are activated electrohydraulically via valves and pilot valves with operating magnets.

FIG. 2 shows the shearer machine, which is moving to the right. For this reason, the coal bumper of the support shield 17 must be retracted. In contrast, the section of the trough 25 consisting of a part of the support shield 9 which is located behind the shearer 21—with respect to the direction of travel 19—is advanced forward onto the mined wall. Likewise, the support shields 8, 7, 6, 5, and 4 are illustrated in forward movement toward the longwall panel and/or the mined wall. The coal bumpers on these support shields are already retracted downward. The support shields 3, 2, 1 are in the final position and remain this way until the shearer approaches again from the right.

The control functions for these movements are carried out partially automatically according to a stored program and depending on the movements and the position of the shearer, and partially by manual local or remote control. For this purpose, a support shield control unit 34 is assigned to each of the support shields 1-18. Each support shield control device 34 is connected to the functional elements of its respective support shield. These include particularly the sensors and the operation magnets of the pilot control valves 45 and/or the main valves 44 of the power source.

The central support shield control system consists of the main central control 50 and the auxiliary central control 51. The program for automatic operation of the support shield control and for automatically issuing support shield commands (clearing, advancing, setting of the shields), said functions being carried out depending on the position of the mining machine, is saved in the main central control 50 and/or the auxiliary central control 51. For this purpose, detected values (sensor signals) of the individual sensors can be acquired by the main central control 50 and/or the auxiliary central control 51 according to the program. Commands can also be issued manually, and sensor signals obtained manually, via the main central control 50 and/or the auxiliary central control 51.

The cable 58 (bus line) connects all support shield control units 34 to each other. The received and/or issued support shield commands, status information, and other data are received by all other support shield control units and are further relayed to all other units.

However, by means of a prespecified coding (support shield codeword), only one of the support shield control units 1-18 or a group of the support shield control units is activated to carry out a requested function, for example a request for sensor values, or a support shield function, such as clearing, advancing, and setting. As such, the activated support shield control unit implements the received function command, for example a sensor value request or support shield command, by converting the same to a command issued to the appropriate support shield functional elements, sensors, control valves, and/or main valves.

The control of the support shield control units of a certain support shield, and the automatic execution of the functions and function processes is known from DE 195 46 427.3 A1, for example.

It is fair to say that the movement processes carried out in a longwall mining operation are very complex and cannot be effectively monitored and predicted by a single person due to the uniqueness of the working environment. For this reason, a detection device 28 is attached to each support shield, which detects the presence of a person in a defined detection zone, and which is connected to the support shield control unit 34. The detection device 28 consists of a radio transmitter 31 and a radio receiver 32. Both communicate with a transponder, i.e. receiver for transmitted signals, and transmitter for reply signals. Each person present in the longwall mine wears such a transponder, for example in his or her headlamp. By means of a radio transmitter 31 and radio receiver 32, it is possible to determine, either continuously or in regular cycles, whether a person is present in the detection zone of the relevant support shield. This occurs particularly when the radio receiver 32 receives a reply signal from the transponder of a person. However, the detection device 28 can also contain an additional sensor 35 which detects the presence of a person automatically and without requiring a reply signal from a person. This sensor can be designed as an infrared sensor, as an ultrasound sensor, or as an optical sensor. In the case of a highly sensitive infrared sensor, a person is detected by means of his or her body temperature. In the case of an ultrasound sensor or an optical sensor, the sensor 35 detects the image in the movement zone and continuously executes comparisons with a previously determined image and/or with certain sufficiently tightly arranged image points, and signals deviations from the same. A detection device 28 of this type, which automatically detects the presence of a person without any reply from the person, is worthy of protection independently from the solution provided according to the invention.

However, the sensor 35 can be embodied as two sensors which work according to two different principles, for the purpose of ensuring the results.

A detection device 28 of this type, which contains two sensors, of which preferably one automatically detects the presence of a person without any reply from the person, is likewise worthy of protection independently from the solution provided according to the invention.

However, the transmitter 35 can also be excluded from the design. In this case, the radio receiver 32 assumes its function. The transmitter 35 and/or radio receiver 32 are tasked with signaling the detection and presence of a person located within their detection zone 37 to the support shield control device 34 which lies in this detection zone and/or within a larger safety zone. For this purpose, the support shield control devices 34 contain switching units by means of which any and all movements of the support shield are halted, and incoming signals for controlling movements are blocked and rendered ineffective.

However, it is conceivable, primarily as indicated by the contents of FIG. 2, that conditions along the longwall during excavation of the coal panel can change drastically, and that zones may exist or may be created during the excavation which are not covered by the detection zone of a detection device 28, but which however likely lie in a zone in which a support shield can possibly move.

In order to avoid the risk to personnel resulting therefrom, the detection zones of multiple detection devices are collected into a single monitored danger zone 38 according to the invention. The danger zone 38 can include, for example, the entire longwall. However, the longwall—as shown here—can also be divided into multiple danger zones 38. Each danger zone is covered in its entirety—insofar as the same is accessible to people—by individual detection devices to the desired degree (as completely as possible in the best case).

Each of the persons present in the longwall mine carries a transponder 39 and an electronic data storage device 40. Both of these can be integrated into a helmet or a mining lamp 41, for example. The personnel data, which are unique to the person, are stored in the storage device 40. The simplest form of these is a codeword, a code number, or another coding signal which is unique to the person and to the transponder.

If the person enters a detection zone, the transponder is activated by means of one of the radio transmitters 31. As a result, the personnel data are automatically transmitted to the radio receiver 32. From there, the coding signal is further relayed to the associated support shield control 34, and from there to one of the devices 33 for the longwall control/central control.

The central control 33 has a storage device 42 in which the coding signals of all persons with access to the danger zone 38 or the longwall are saved, wherein the persons are logged off upon leaving the longwall area. The individual central controllers 33 transmit the saved and also the logged-out personnel data to the main central control 50 and/or to the auxiliary central control 51. Also, if the longwall is divided into multiple danger zones, all persons who enter the longwall area and/or leave the longwall area are included in the main central control 50 and/or the auxiliary central control 51. For this purpose, the main central control 50 and the auxiliary central control 51 constantly and automatically communicate with the central controllers 33.

At this point, all personnel data stored in the main central control 50 and/or the auxiliary central control 51 are constantly available to each of the central controllers 33. These saved personnel data of persons who must still be in the longwall area or in one of the danger zones 38 are at this point constantly compared to the personnel data detected by the detection devices 28 of all of the excavation devices/support shields and/or the device control unit 34 thereof at the same time. For this purpose, these updated personnel data are also quickly relayed to all of the central controllers 33 and to the main central control 50 and/or auxiliary central control 51. As such, a central check is carried out on the basis of the presence of a person, whereby the personnel data of persons who have entered the area are compared to the personnel data of persons currently located in a detection zone.

If a discrepancy arises between the saved personnel data and the detected personnel data, the central control unit 33 or the main central control 50 or the auxiliary central control 51 executes a data command which halts all functions of the excavation devices and interrupts all moving functions, said data command being directed at the switching devices of all excavation devices, e.g. support shields 1-18. Operation is only resumed when the discrepancy is rectified. Until that point, the longwall is out of operation, such that persons who have "disappeared" (whose transponders are defective or for some other reason have stopped functioning, or whose location is not covered by the safety zone of the excavation devices) do not come to harm.

That which is claimed:

1. A safety device for movable excavation devices in an underground longwall mine, wherein a device control unit is assigned to each excavation device, by means of which the moving functions of each respective excavation device can be controlled via data input devices, and a central controller is assigned to multiple excavation devices for the purpose of detecting moving functions of the excavation devices, and controlling the same in a chronological process, said safety device comprising:

a detection device on each of the support shields for the purpose of detecting the presence of a person in a defined detection zone, wherein the detection device has a radio transmitter and a radio signal receiver, and communicates with transponders which are worn by persons present in the longwall mine, and switching devices arranged on each of the device control units for the purpose of halting the functions of the associated excavation device and/or for the purpose of interrupting the data input to the same, wherein said functions and/or data input result in moving functions of the excavation device, if a person is present in the working zone of the excavation device when the excavation device is working, wherein multiple detection areas are collected into a danger zone, wherein the personnel data of all persons located in the danger zone are centrally stored as an updated personnel status for the danger zone, wherein the detection devices are operated continuously or in regular cycles to constantly detect the personnel data of the persons located in the detection zone thereof and report to the central controller for the danger zones, wherein the saved updated personnel status in the danger zone and all the detected personnel data for one of the associated detection zones are constantly compared for concordance, and wherein if a discrepancy arises between the saved data status and the detected personnel data, the central control unit can execute a data command which halts all functions of the excavation devices and interrupts all moving functions, said data commands being directed at the switching devices of all excavation devices.

* * * * *